US010905930B2

(12) United States Patent
Hanfland

(10) Patent No.: US 10,905,930 B2
(45) Date of Patent: Feb. 2, 2021

(54) ELECTRONIC DEVICE FOR ALIGNING A MARKED GOLF BALL

(71) Applicant: Mark Joseph Hanfland, Brentwood, TN (US)

(72) Inventor: Mark Joseph Hanfland, Brentwood, TN (US)

( * ) Notice: Subject to any disclaimer, the term of this patent is extended or adjusted under 35 U.S.C. 154(b) by 0 days.

(21) Appl. No.: 16/665,074

(22) Filed: Oct. 28, 2019

(65) Prior Publication Data

US 2020/0179775 A1 Jun. 11, 2020

Related U.S. Application Data

(60) Provisional application No. 62/777,452, filed on Dec. 10, 2018.

(51) Int. Cl.

| | |
|---|---|
| ***A63B 57/00*** | (2015.01) |
| ***A63B 37/00*** | (2006.01) |
| ***A63B 45/02*** | (2006.01) |
| ***A63B 47/00*** | (2006.01) |
| *A63B 71/06* | (2006.01) |

(52) U.S. Cl.

CPC ..... *A63B 57/0006* (2013.01); *A63B 37/0003* (2013.01); *A63B 37/0022* (2013.01); *A63B 45/02* (2013.01); *A63B 47/008* (2013.01); *A63B 2071/0694* (2013.01); *A63B 2220/05* (2013.01); *A63B 2220/18* (2013.01); *A63B 2220/805* (2013.01); *A63B 2225/74* (2020.08)

(58) Field of Classification Search

None

See application file for complete search history.

(56) References Cited

U.S. PATENT DOCUMENTS

| | | | | |
|---|---|---|---|---|
| 4,209,172 | A | 6/1980 | Yamamoto | |
| 4,546,644 | A | 10/1985 | Beny et al. | |
| 4,974,511 | A | 12/1990 | Hsi-Chou | |
| 5,471,383 | A * | 11/1995 | Gobush | A63B 69/0026 700/91 |
| 5,632,205 | A | 5/1997 | Gordon et al. | |
| 6,241,622 | B1 * | 6/2001 | Gobush | G01S 17/89 473/199 |
| 6,813,936 | B2 | 11/2004 | Burnett | |
| 7,299,685 | B1 * | 11/2007 | Burnett | A63B 45/02 101/38.1 |
| 9,108,087 | B2 | 8/2015 | Hornung | |
| 9,504,881 | B2 | 11/2016 | Hebert et al. | |
| 2002/0189468 | A1 * | 12/2002 | Sosin | A63B 37/0003 101/35 |
| 2003/0213289 | A1 * | 11/2003 | Burnett | A63B 47/008 73/65.02 |

* cited by examiner

*Primary Examiner* — Jason T Yen

(74) *Attorney, Agent, or Firm* — Law Office of Ilya Libenzon

(57) ABSTRACT

A small electronic device used to perform alignment of a lined golf ball in preparation for putting. The device is battery powered and includes one or more motors for rotating the golf ball at a high speed. The device further includes one or more photonic line sensors disposed at the golf ball for identifying the line on the golf ball and for communicating with a microcontroller which coordinates the electric rotation motors to align the golf ball to the device. The electronic device also features a mechanical loading mechanism which holds the golf ball for rotation during the alignment process and releases the golf ball to the putting green without rotation when alignment is complete.

15 Claims, 5 Drawing Sheets

Example Device Enclosure Removed

Example Device #2 Ball Loaded and Aligned

Figure 1. Example Device Perspective View
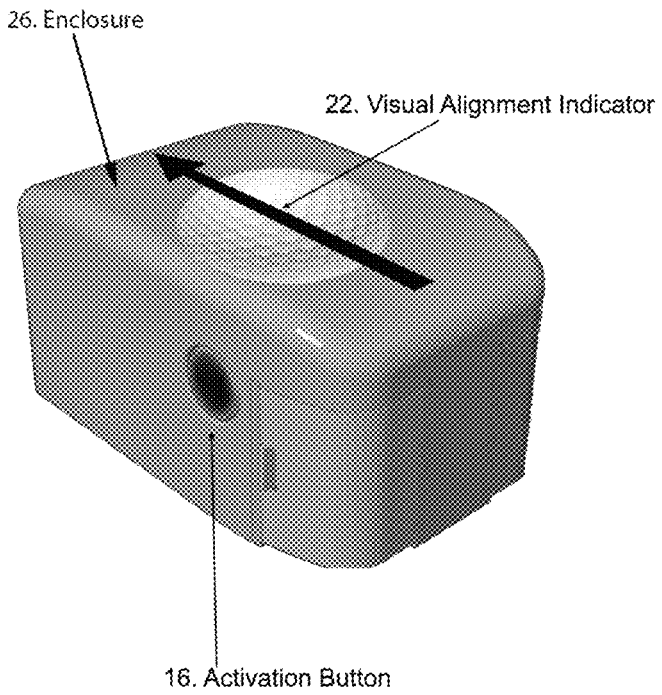
Figure 2. Example Device Transparent Perspective View
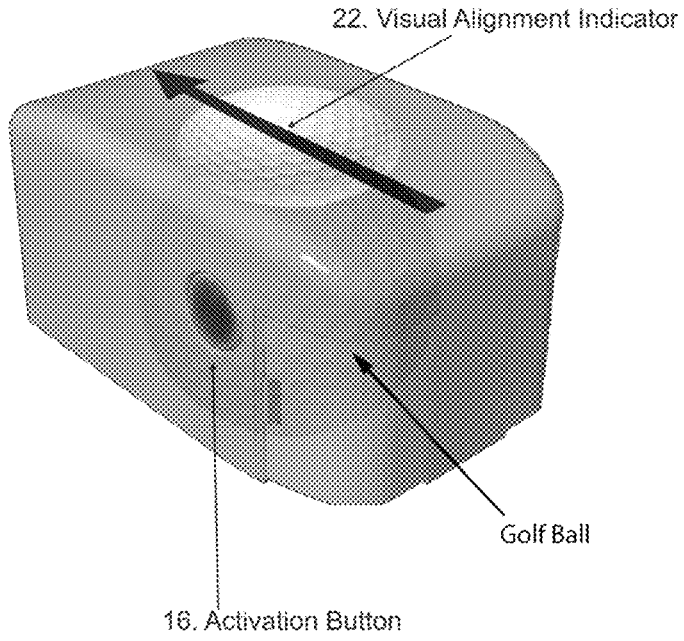

Figure 3. Example Device Enclosure Removed
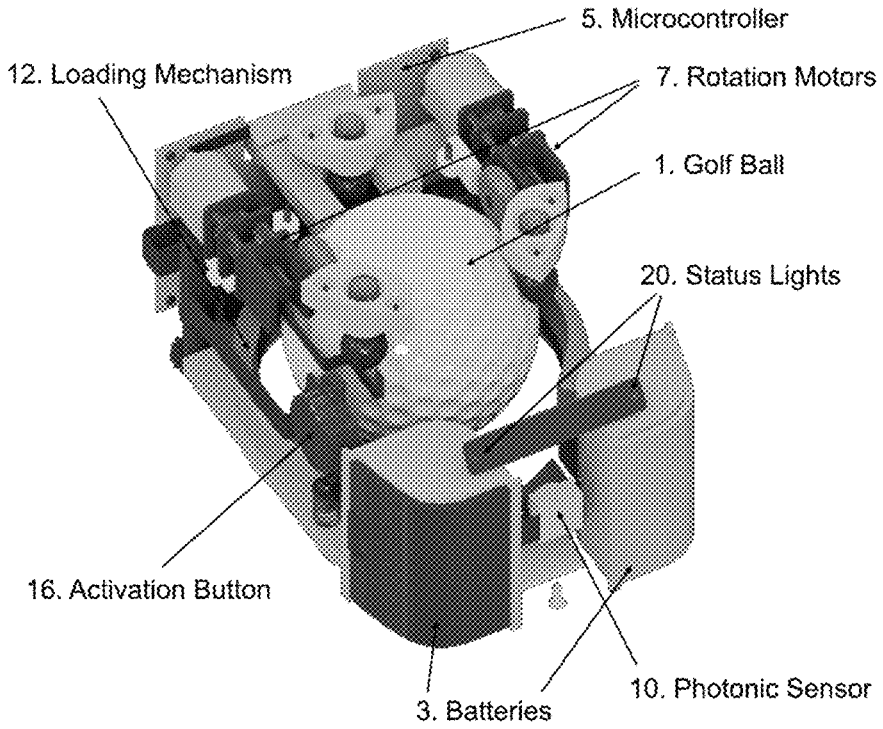
Figure 4. Example Device Side View Enclosure Removed
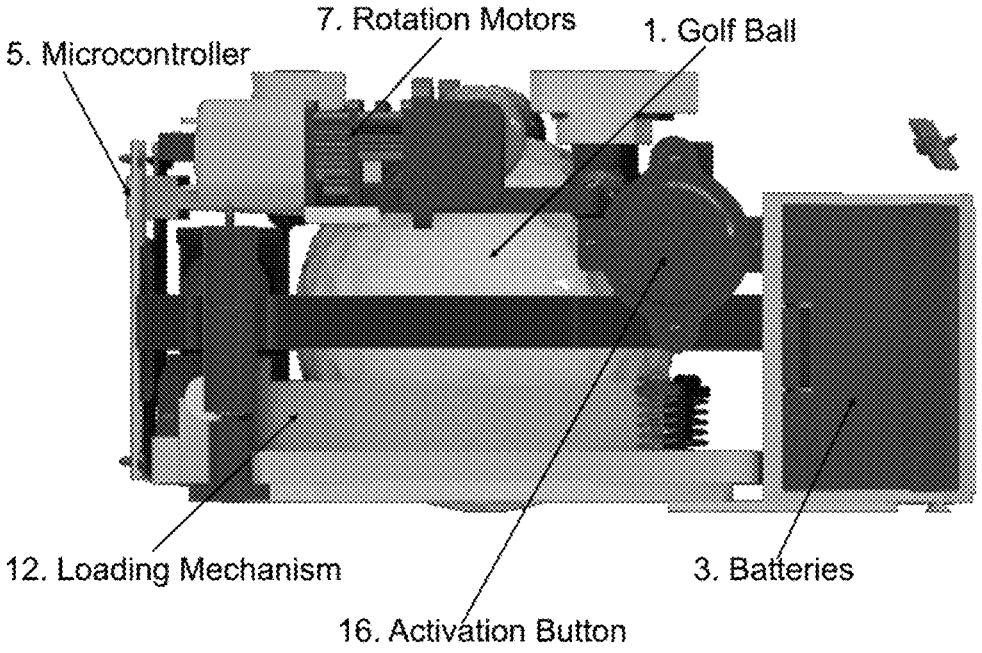

Figure 5A. Lined Golf Ball Example
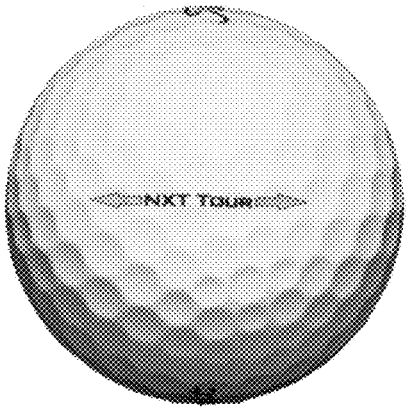
Figure 5B. Lined Golf Ball Example
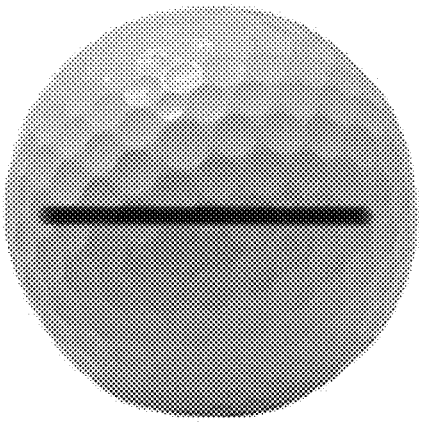
Figure 6. Example Device #2
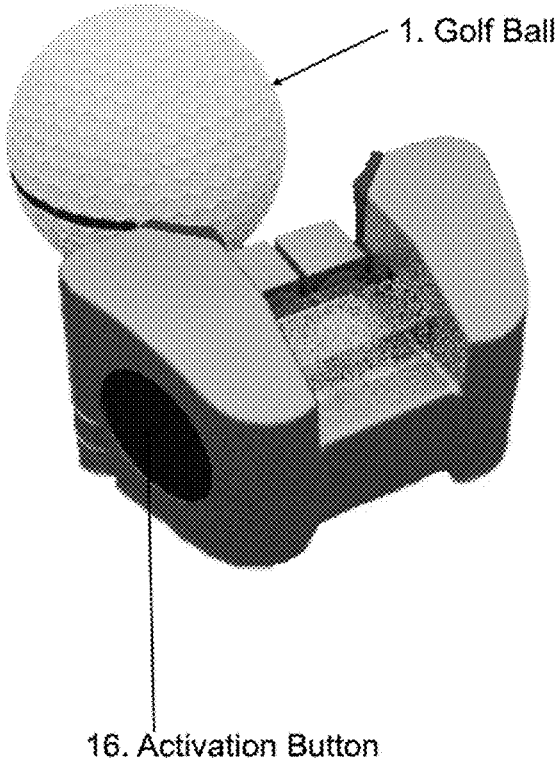

Figure 7. Example Device #2 Ball Loaded and Aligned
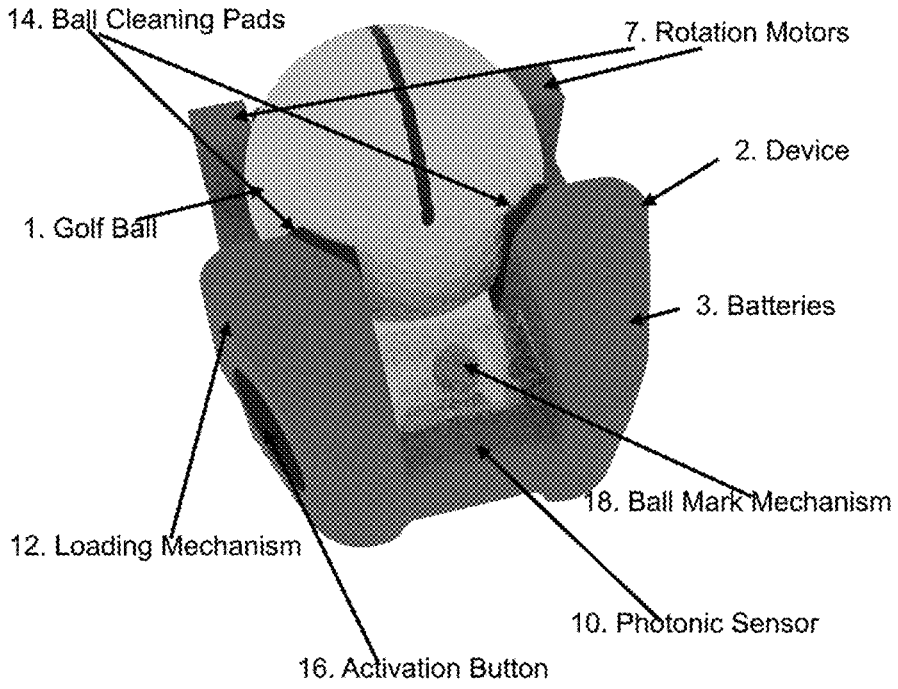

Figure 8. Example Device #2 Top Enclosure Removed
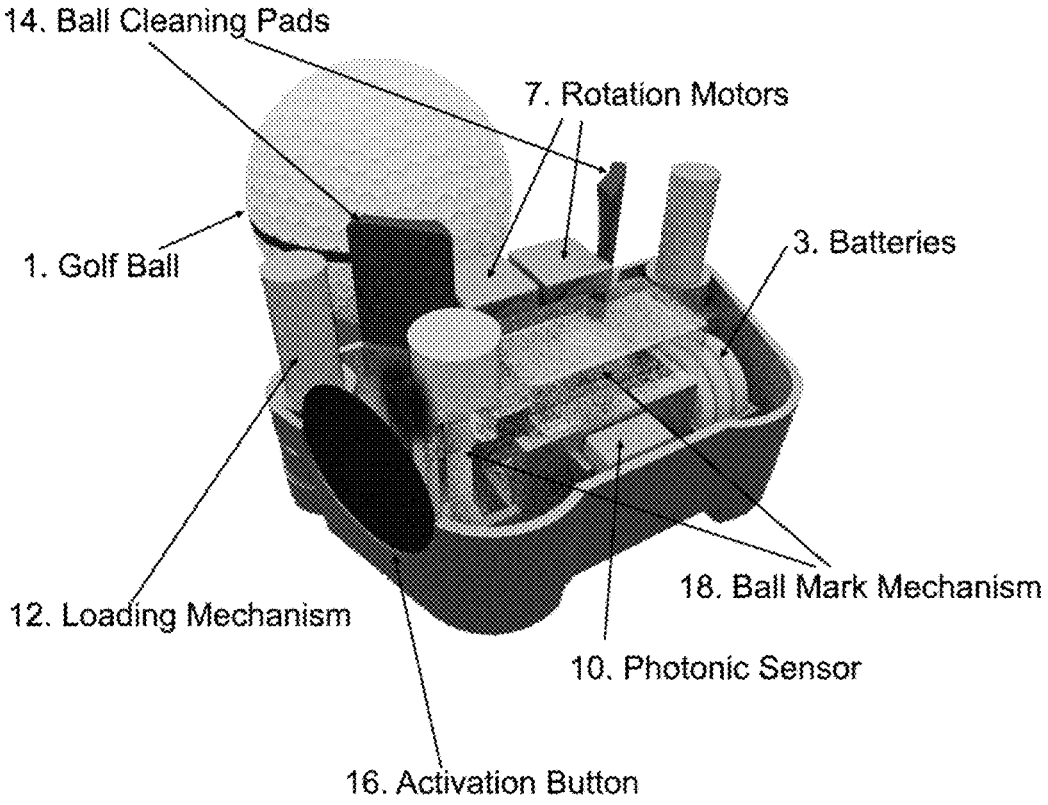

ELECTRONIC DEVICE FOR ALIGNING A MARKED GOLF BALL

TECHNICAL FIELD

Embodiments disclosed herein relate generally to an electronic device for aligning a marked golf ball in preparation for putting.

BACKGROUND ART

Recently it has become popular for golfers to use a line on their golf ball to assist them with aiming their putts on their intended target. Many golf ball manufactures include a line on their golf ball product to allow golfers to aim their golf ball to their intended target using the line on the golf ball. Many golfers also place lines on the golf ball themselves with a marker for a similar purpose. Aiming a lined golf ball to the golfers' intended target is not simple due to the small size of a golf ball, the visual point of view of the golfer during alignment, the curvature of the line on the ball, and the slope that exists on golf putting greens. Due to the aforementioned complexities, using a line on a golf ball for alignment is difficult to complete by hand and often adversely affects the pace of play, an important factor in the game of golf.

Therefore, there is a need for an electronic golf ball alignment device that is compact, easy to use, and most importantly is effective and efficient in assisting the golfer in preparation for putting to quickly and accurately align a marked golf ball on their intended target.

SUMMARY OF THE EMBODIMENTS

The present invention provides an electronic device for aligning a marked golf ball (i.e., a golf ball having a line drawn thereon) for putting, which requires less time to complete the alignment in comparison with the prior art devices currently used by golfers.

According to the embodiments of the present disclosure, the electronic device loads the marked golf ball, automatically rotates and distinguishes the line drawn on the golf ball from other markings/lettering, aligns the line on the golf ball to the device, and releases the golf ball onto the green with the golf balls' line aligned to the device.

The device is powered by one or more batteries, such as lithium ion CR2 batteries.

The device includes a microcontroller which coordinates the devices' electronic components. The microcontroller includes a processor, memory and input/output (I/O) peripherals wired to a PCB chip.

The device contains a ball loading and release mechanism which consists of electro-mechanical components used to load the golf ball into a fixed position relative to the device and releases it once the alignment process is complete.

The device includes one or more rotation motors controlled by the microcontroller for spinning the golf ball upon a fixed axis relative to the device. The motor(s) allow the microcontroller to rotate the golf ball upon its axis with high speed and high precision.

The device contains a photonic sensor, such as a CMOS sensor, which creates signals sent to the microcontroller based on the reflectivity of different wavelengths of light bounced against the loaded golf ball.

The device includes a power activation mechanism used by the golfer to enable the device. The activation mechanism may be a button or similar electrical power switching mechanism.

To begin the process the golfer must have a lined golf ball on the green or similar flat surface (ground) and activate the device using the activation mechanism.

Once activated, the golfer initiates the loading process with a lined golf ball. The device loading method varies between device embodiments. The result of the device loading process is the golf ball is moved to a fixed position relative to the device such that the golf ball can be rotated on its axis.

Once loaded, the device rotates the golf ball at a high speed on its axis using the rotation motors while detecting the line on the golf ball using the photonic sensor. Once the line is detected the device aligns the line on the golf ball to the device.

The device completes the process by releasing the golf ball onto the green. When releasing the golf ball, the device places the golf ball on the green such that the line on the golf ball maintains its alignment to the device (the golfers intended line of target).

Other aspects, embodiments and features of the device and method will become apparent from the following detailed description when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the device and method shown where illustration is not necessary to allow those of ordinary skill in the art to understand the device and method.

BRIEF DESCRIPTION OF THE DRAWINGS

The preceding summary, as well as the detailed description of the disclosed device and method, can best be understood in conjunction with the attached drawings. It should be understood, however, that neither the pictured devices nor the method is limited to the precise arrangements and instrumentalities shown.

FIG. 1 is a perspective view of an electronic device embodying the invention.

FIG. 2 is a perspective view of an electronic device embodying the invention transparently displaying the position of a loaded golf ball.

FIG. 3 is a perspective view of an electronic device embodying the invention without the outer enclosure.

FIG. 4 is a side view of an electronic device embodying the invention without the outer enclosure.

FIG. 5A shows a golf ball with line drawn during manufacturing.

FIG. 5B shows a golf ball with line drawn by golfer using marking pen.

FIG. 6 is a perspective view of a second electronic device embodying the invention.

FIG. 7 is a perspective view of a second electronic device with a golf ball loaded and aligned.

FIG. 8 is a perspective view of a second electronic device with the top enclosure removed.

DETAILED DESCRIPTION OF SPECIFIC EMBODIMENTS

Referring now to the drawings in detail, the device has a manufactured enclosure (26), as shown in FIGS. 1-2, made of weather resistant materials such as plastic and metal.

The device requires power, which is provided by one or more batteries (3), such as lithium ion CR2 batteries, as illustrated in FIG. 3 for example.

The device (2) includes a microcontroller (5) which coordinates the devices' electronic components. The microcontroller includes a processor, memory and input/output (I/O) peripherals using a PCB chip.

The device (2) includes one or more rotation motors (7) controlled by the microcontroller for spinning the golf ball upon a fixed axis relative to the enclosure. The motor(s) allow the microcontroller to rotate the golf ball (1) upon its axis with high speed and high precision.

The device contains a photonic sensor (10), such as a CMOS sensor, which creates signals sent to the microcontroller (5) based on the reflectivity of different wavelengths of light bounced against the golf ball (1).

The device contains a ball loading and release mechanism (12) which consists of electro-mechanical components used to load the golf ball (1) into a fixed position relative to the device (2) and release it once the alignment process is complete. The loaded golf ball is rotated around its axis by the rotation motor(s) (7) while it is loaded. In some embodiments, the device uses electro-mechanical arms to load and release the golf ball.

In some embodiments, the device enclosure includes sensor lights (not shown) to bounce light waves off of the golf ball for the photonic sensor (10) to measure.

The device includes an activation mechanism (16) used by the golfer to activate the device (power it on). The activation mechanism is a button or similar electrical power switching mechanism.

In some embodiments, the device includes a ball mark mechanism (18), as illustrated in FIG. 7, for example. Once the device (2) has loaded the golf ball (1) the ball mark mechanism (18) releases a ball mark (a coin shaped disk) from the bottom of the device onto the golf green to mark the location of where the ball was loaded. In some embodiments, the ball mark used by the device is made of a magnetic attracting material (iron, nickel, cobalt) and the device uses a magnetic field to release and reattach the ball mark to the device (2).

In some embodiments, the device will provide indicator lights (20) or similar visual display to notify the golfer as to the status of the devices' golf ball alignment process.

In some embodiments, the top of the enclosure provides visual indication (22) of the alignment of the ball to the device which is used by the golfer to aim on their intended putting line.

In some embodiments, the device includes brush pads (24) which clean the golf ball while it is being rotated by the rotation motors.

In some embodiments, the device includes an inclinometer in the enclosure to measure the slope the device is on when resting on the green.

In some embodiments, the device includes a global positioning chip within the enclosure to determine the devices' location relative to the golf course.

In some embodiments, the device includes a laser range measurement component within the enclosure to determine the devices' distance to the flag.

In some embodiments, the device includes a wireless networking chip, such as a Blue Tooth protocol chip, to communicate with the golfers' smart phone or similar personal hand held device.

To begin the process the golfer must have a lined golf ball (1) on the green or similar flat surface (ground) and activate the device (2) using the activation mechanism (16).

Once activated, the device (2) can perform the loading process with the lined golf ball. The outcome of the device loading process is the golf ball is placed into a fixed position relative to the device such that the golf ball can be rotated on its axis. In some embodiments, the device is placed near the golf ball to initiate the loading process. In other embodiments, the device is placed over a golf ball on the ground to initiate the loading process. In other embodiments, the ball is placed in the device to initiate the loading process. The loading process may be initiated by the activation button (16) or once the photonic sensor and microcontroller determines a golf ball is in the appropriate position for loading.

In some embodiments, once the device has loaded the golf ball the device ball mark mechanism (18) releases a ball mark (a coin shaped disk) from the bottom of the device (2) onto the golf green to mark the location of where the ball was loaded from.

Once the golf ball (1) is loaded, the device (2) rotates the golf ball at a high speed on its axis using the rotation motors (7), detects the line on the golf ball using the photonic sensor (10), and aligns the line on the golf ball to the device. While the golf ball is being rotated at a high speed by the rotation motors (7), the photonic sensor (10) samples different perspectives of the surface of the golf ball and transmits raw sensor data to the microcontroller (5). The microcontroller (5) includes software to process the sensor data and calculate the optimal alignment of the ball to the device. The microcontroller (5) is programmed to detect different golf ball line markings, including manufactured line markings (5*a*) or line markings drawn by the golfer (5*b*) and align the device to the optimal line marking on the ball. Once the microcontroller (5) has detected the optimal alignment from the photonic sensor data (10), the microcontroller communicates with one or more rotation motors (7) in order to align the golf ball (1) to the device (2) based on its calculations.

As illustrated in FIG. 7, in some embodiments, the device (2) holds the golf ball against cleaning pads or brushes (14) during the rotation of the golf ball. The cleaning pads remove dirt and debris from the ball.

In some embodiments, the device (2) provides visual indication of the status of the ball alignment using led lighting or similar, such as status lights 20 shown in FIG. 3, for example.

The device completes the process by releasing the golf ball (1) onto the green. When releasing the golf ball, the device places the golf ball on the green such that the line on the golf ball maintains its alignment to the device (the golfers intended line of target). In some embodiments, the golfer presses the activation button (16) to release the golf ball, in other embodiments the golf ball is released as soon as the golf ball alignment is complete. If the device has a ball mark mechanism the ball mark is retrieved when the golf ball is released.

While at least one exemplary embodiment has been presented in the foregoing detailed description of the invention, it should be appreciated that a vast number of variations exists. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements.

The foregoing detailed description is merely exemplary in nature and is not intended to limit the invention or application and uses of the invention. Furthermore, there is no intention to be bound by any expressed or implied theory presented in the preceding technical field, background, brief summary, or the following detailed description.

What is claimed is:

1. An electronic device for aligning a marked golf ball comprising:

an enclosure;

a microcontroller having a processor, memory and input/output peripherals;

at least one rotation motor controlled by the microcontroller and configured to spin the golf ball upon a fixed axis relative to the enclosure;

a ball loading and release mechanism configured to load the golf ball into a fixed position relative to the electronic device and release the golf ball once an alignment process is complete;

at least one battery for providing power to the device;

a photonic sensor configured to create signals for sending to the microcontroller based on the reflectivity of different wavelength of light bounced against the golf ball; and an activation mechanism configured to activate the device by powering it on.

2. A device according to claim 1, wherein the ball loading and release mechanism comprises one or more electromechanical arms configured to load and release the golf ball.

3. A device according to claim 1, wherein the activation mechanism is a button or a switch.

4. A device according to claim 1, further comprising a sensor light source configured to bounce light waves off of the golf ball for the photonic sensor to measure.

5. A device according to claim 1, further comprising a ball mark mechanism configured to release a ball mark from a bottom of the device onto golf green to mark a golf ball loading location.

6. A device according to claim 5, wherein the ball mark is made of a magnetic attracting material and the ball mark mechanism is configured to use a magnetic field to release and reattach the ball mark to the device.

7. A device according to claim 1, further comprising one or more indicator lights for indicating the status of the golf ball alignment process.

8. A device according to claim 1, wherein the enclosure further comprises a transparent window.

9. A device according to claim 1, wherein the enclosure further comprises a visual alignment indicator for providing visual indication of the alignment of the golf ball to the device for assisting a golfer to aim at an intended putting line.

10. A device according to claim 1, further comprising one or more ball cleaning pads configured to clean the golf ball while it is being rotated by the at least one rotation motor.

11. A device according to claim 1, further comprising an accelerometer or inclinometer configured to measure the slope of the green on which the device is resting.

12. A device according to claim 1, further comprising a global position sensor configured to determine a location of the device relative to a golf course.

13. A device according to claim 1, further comprising a laser range finder configured to measure a distance from the device to a flag.

14. A device according to claim 1, further comprising a wireless networking component configured to wirelessly communicate with a mobile device of a golfer.

15. A method of using the device according to claim 1, said method comprising the steps of:

placing a marked golf ball on the ground;

activating the device by engaging the activation mechanism;

loading the golf ball by the ball loading and release mechanism;

calculating an optimal alignment of the ball by the microcontroller;

rotating and aligning the golf ball by one or more rotating motors based on the optimal alignment calculation; and releasing the golf ball onto the ground by the ball loading and release mechanism.

* * * * *